US012631424B1

(12) United States Patent
Orland et al.

(10) Patent No.: US 12,631,424 B1
(45) Date of Patent: May 19, 2026

(54) REUSABLE LAUNCHING TUBE FOR CONSUMER FIREWORKS

(71) Applicant: Jake's Fireworks Inc., Pittsburg, KS (US)

(72) Inventors: Aaron S Orland, Carl Junction, MO (US); Carl R Whitmarsh, Owasso, OK (US)

(73) Assignee: Jake's Fireworks Inc., Pittsburg, KS (US)

( * ) Notice: Subject to any disclaimer, the term of this patent is extended or adjusted under 35 U.S.C. 154(b) by 0 days.

(21) Appl. No.: 19/086,851

(22) Filed: Mar. 21, 2025

(51) Int. Cl.

| | |
|---|---|
| ***F41F 1/06*** | (2006.01) |
| ***F42B 4/00*** | (2006.01) |
| ***F42B 4/20*** | (2006.01) |
| *F42B 4/24* | (2006.01) |

(52) U.S. Cl.
CPC ..... *F41F 1/06* (2013.01); *F42B 4/00* (2013.01); *F42B 4/20* (2013.01); *F42B 4/24* (2013.01)

(58) Field of Classification Search
CPC ..... F42B 4/00; F42B 4/02; F42B 4/10; F42B 4/14; F42B 4/20; F42B 4/22; F42B 4/24; F42B 4/26; F41F 1/06
USPC ..... 102/342, 343, 349, 351, 357, 358
See application file for complete search history.

(56) References Cited

U.S. PATENT DOCUMENTS

| | | | | |
|---|---|---|---|---|
| 2,448,521 | A * | 9/1948 | Dwyer | F42B 4/26 220/768 |
| 3,280,744 | A | 10/1966 | Brown | |
| 3,762,327 | A * | 10/1973 | Murray | F42B 4/26 102/341 |
| 5,094,422 | A | 3/1992 | Tiffany | |
| 6,286,429 | B1 | 9/2001 | Marietta | |
| 6,457,415 | B1 * | 10/2002 | Peter Sung Yan | F42B 4/22 102/361 |
| 6,851,371 | B1 | 2/2005 | Wah | |
| D541,898 | S | 5/2007 | Marietta | |
| 8,720,340 | B1 | 5/2014 | Kendrix | |
| 8,807,037 | B2 | 8/2014 | Marietta | |
| 9,038,540 | B2 * | 5/2015 | Brosky | F41F 1/06 102/485 |
| 9,885,549 | B2 * | 2/2018 | Marietta | F42B 4/02 |
| 10,317,170 | B2 * | 6/2019 | Wu | F42B 4/00 |
| 11,536,545 | B2 * | 12/2022 | Monetti | H01R 12/714 |

(Continued)

FOREIGN PATENT DOCUMENTS

| | | |
|---|---|---|
| CN | 2558981 Y | 8/2002 |

OTHER PUBLICATIONS https://cults3d.com/en/3d-model/various/roman-candle-holder-30mm.

*Primary Examiner* — James S Bergin
(74) *Attorney, Agent, or Firm* — Hovey Williams LLP

(57) ABSTRACT

A multiple-use fireworks launching tube for the launching of consumer fireworks such as an aerial display shell having a lower lift charge and an upper effect charge. The launching tube includes a base and a one-piece, elongated tube extending from the base. The elongated tube has a tubular wall with a reinforcing lower section that includes a series of outwardly extending circumferential ribs that are spaced apart by recessed circumferential regions located between adjacent ones of the circumferential ribs. A tubular wall thickness of the circumferential ribs may be greater than a tubular wall thickness of an upper section of the tubular wall. Circumferentially spaced-apart ribs extend between the adjacent ones of the circumferential ribs.

18 Claims, 5 Drawing Sheets

(56) References Cited

U.S. PATENT DOCUMENTS

D1,025,276 S 4/2024 Jiang
D1,077,125 S * 5/2025 Orland ..... D22/113

* cited by examiner

REUSABLE LAUNCHING TUBE FOR CONSUMER FIREWORKS

BACKGROUND

The present disclosure is directed to fireworks launching tubes of the type commonly used in the launching of consumer fireworks. More particularly, the invention is directed to reusable launching tubes for fireworks such as aerial display shells, commonly referred to as artillery shells.

As used herein, "consumer fireworks" has the meaning set forth in Title 27, Code of Federal Regulations, Section 555.11, as small fireworks devices designed to produce visible effects by combustion and which comply with the construction, chemical composition, and other requirements of the U.S. Consumer Product Safety Commission, as set forth in Title 16, Code of Federal Regulations, parts 1500 and 1507.

Consumer fireworks aerial display shells of the type intended to be placed within and then launched from a launching tube are well known and are commonly referred to as reloadable artillery shells or mortars. An example of one such aerial display shell is disclosed in U.S. Pat. No. 6,912,958. The aerial display shell disclosed in that patent has a cylindrical casing and a long lead fuse, commonly referred to as a shell leader, that ignites a lift charge housed at one end of the casing. When ignited, the lift charge propels the aerial display shell upwardly and out of the launching tube. The aerial display shell includes an effects charge, comprised of stars and a burst charge, which is separated from the lift charge in the casing and produces the pyrotechnic visual effects display. The effects charge is ignited by a timing or delay fuse. The timing fuse is ignited by the burning lift charge and burns while the aerial display shell is being propelled along the length of the internal passage formed in the launching tube and during its upward ballistic travel outside the launching tube. The burn time of the timing fuse is set to allow fire to be communicated to the effects charge once the aerial display shell has reached or nearly reached the apex in its ballistic trajectory.

The aerial display shell described above is properly oriented within the internal passage of the launching tube when the lift charge is resting on the bottom of the launching tube and the effects charge is positioned above the lift charge. When oriented in this manner, the hot product gases of the ignited lift charge exert a force against the bottom of the aerial display shell and propel the aerial display shell upwardly out of the launching tube through its open top.

If a user inadvertently places an aerial display shell within the launching tube in an inverted orientation, the hot product gases of the burning lift charge are vented upwardly through the open top of the launching tube rather than acting to propel the aerial display shell upwardly and out of the launching tube. As a result, the aerial display shell remains resting on the closed bottom of the launching tube when the effects charge is ignited, and an overpressure may be created that may cause the launching tube to rupture.

One approach to reducing the potential for rupturing of the launching tube is to use a reinforcing sleeve surrounding a lower portion of the launching tube, such as is disclosed in U.S. Pat. No. 8,807,037. The reinforcing sleeve in that patent strengthens the launching tube in the area where the aerial display shell is positioned when resting on the bottom of the launching tube. In the commercial process used to manufacture the launching tube and reinforcing sleeve, the reinforcing sleeve is formed by injection molding it separately from the injection molding of the launching tube. The reinforcing sleeve is then slid onto the tubular portion of the launching tube soon after the reinforcing sleeve is removed from the injection molding machine and while it is at an elevated temperature so that as it cools it will shrink to tightly grip the exterior surface of the tubular portion of the launching tube.

Injection molding a launching tube as a single piece with a thicker lower wall in place of the separate reinforcing sleeve would eliminate the cost and time spent separately molding and then assembling the reinforcing sleeve onto the tubular portion of the launching tube. One challenge to molding the launching tube with different wall thicknesses is the thinner-walled upper portion will cool more quickly than the thicker-walled lower portion during the injection molding process. As a result, the cooler upper portion of the launching tube will shrink and more tightly grip the forming core than the warmer lower portion, which can make removal of the launching tube from the forming core more difficult. In order to reduce the stress on the mold and on launching tube as it is being ejected from the forming core, the ejection should occur before the upper portion of the launching tube grips the forming core too tightly. However, if the ejection occurs too soon, the lower portion of the launching tube may not have cooled and hardened sufficiently to maintain its shape following ejection.

As a result, there is a need for improvements in the launching tube that allow it to be manufactured in a manner that reduces the ejection stresses on the launching tube and the injection mold, while allowing the launching tube to harden sufficiently so that it maintains its shape after ejection.

BRIEF DESCRIPTION

This brief description is provided to introduce a selection of concepts in a simplified form that are further described in the detailed description below. This brief description is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

In one aspect, the present disclosure is directed to a launching tube for launching a consumer fireworks aerial display shell having a lift change and an effects charge. The launching tube comprises: a base; and an elongated tube extending from the base and comprising a tubular wall having an outer surface and an inner surface that defines a cylindrical interior passage for receiving and guiding an aerial display shell during its launch. The interior passage extends in a direction toward the base from an open end that is remote from the base. The tubular wall has a reinforcing lower section that is located between the base and an upper section of the tubular wall. The reinforcing lower section of the tubular wall comprising a series of spaced-apart circumferential ribs that extend in a direction outwardly from the inner surface and have a tubular wall thickness that is greater than a tubular wall thickness formed by circumferential regions that are located between adjacent ones of the circumferential ribs.

In another aspect, the present disclosure is directed to a launching tube for launching a consumer fireworks aerial display shell having a lift change and an effects charge. The launching tube comprising: a base; and a one-piece elongated tube formed integrally with and extending from the base, the elongated tube comprising a tubular wall having an outer surface and an inner surface that defines a cylindrical interior passage for receiving and guiding an aerial display shell during its launch. The interior passage extends in a direction toward the base from an open end that is remote from the base. The tubular wall has a reinforcing lower section that is located between the base and an upper section of the tubular wall. The reinforcing lower section of the tubular wall comprises: a series of spaced-apart circumferential ribs that extend in a direction outwardly from the inner surface and have a tubular wall thickness that is greater than a tubular wall thickness formed by circumferential regions that are located between adjacent ones of the circumferential ribs; and circumferentially spaced-apart connecting ribs extending between adjacent pairs of the circumferential ribs.

In a further aspect, the present disclosure is directed to a launching tube formed of high-density polyethylene for launching a consumer fireworks aerial display shell having a lift change and an effects charge. The launching tube comprises: a base; and a one-piece elongated tube formed integrally with and extending from the base, the elongated tube comprising a tubular wall having an outer surface and an inner surface that defines a cylindrical interior passage for receiving and guiding an aerial display shell during its launch. The interior passage extends in a direction toward the base from an open end that is remote from the base. The tubular wall has a reinforcing lower section that is located between the base and an upper section of the tubular wall. The reinforcing lower section of the tubular wall comprises: a series of circumferential ribs that extend in an outward direction from the inner surface and are spaced apart by circumferent regions that are located between adjacent ones of the circumferential ribs, the circumferential ribs having a tubular wall thickness that is greater than a tubular wall thickness of the circumferential regions; and circumferentially spaced-apart connecting ribs extending between the adjacent ones of the circumferential ribs. The tubular wall thickness of the circumferential ribs is greater than a tubular wall thickness of the upper section of the tubular wall. The tubular wall thickness of the circumferential regions that are located between adjacent ones of the circumferential ribs is greater than the tubular wall thickness of the upper section of the tubular wall. A longitudinal length of the upper section of the tubular wall is greater than a longitudinal length of the reinforcing lower section.

BRIEF DESCRIPTION OF THE DRAWINGS

The present disclosure is described in detail below with reference to the attached drawing figures, wherein.

DETAILED DESCRIPTION

The subject matter of the present disclosure is described with specificity herein to meet statutory requirements. However, the description itself is not intended to limit the scope of this patent. Rather, the inventors have contemplated that the claimed subject matter might also be embodied in other ways, to include different components and combinations of components similar to the ones described in below, in conjunction with other present or future technologies.

Turning now to the drawings in greater detail, a reusable launching tube of the present disclosure is designated generally by the number 10. The launching tube 10 is design to be used for launching consumer fireworks, such as aerial display shells having a lift charge and an effects charge. These types of aerial display shells are also commonly referred to in the consumer fireworks industry as artillery shells or mortars. In order to allow repeated use of the launching tube 10, it may be injection molded using a thermoplastic polymer. High-density polyethylene is one example of a suitable thermoplastic polymer that may be used for the launching tube 10.

Figure 1:
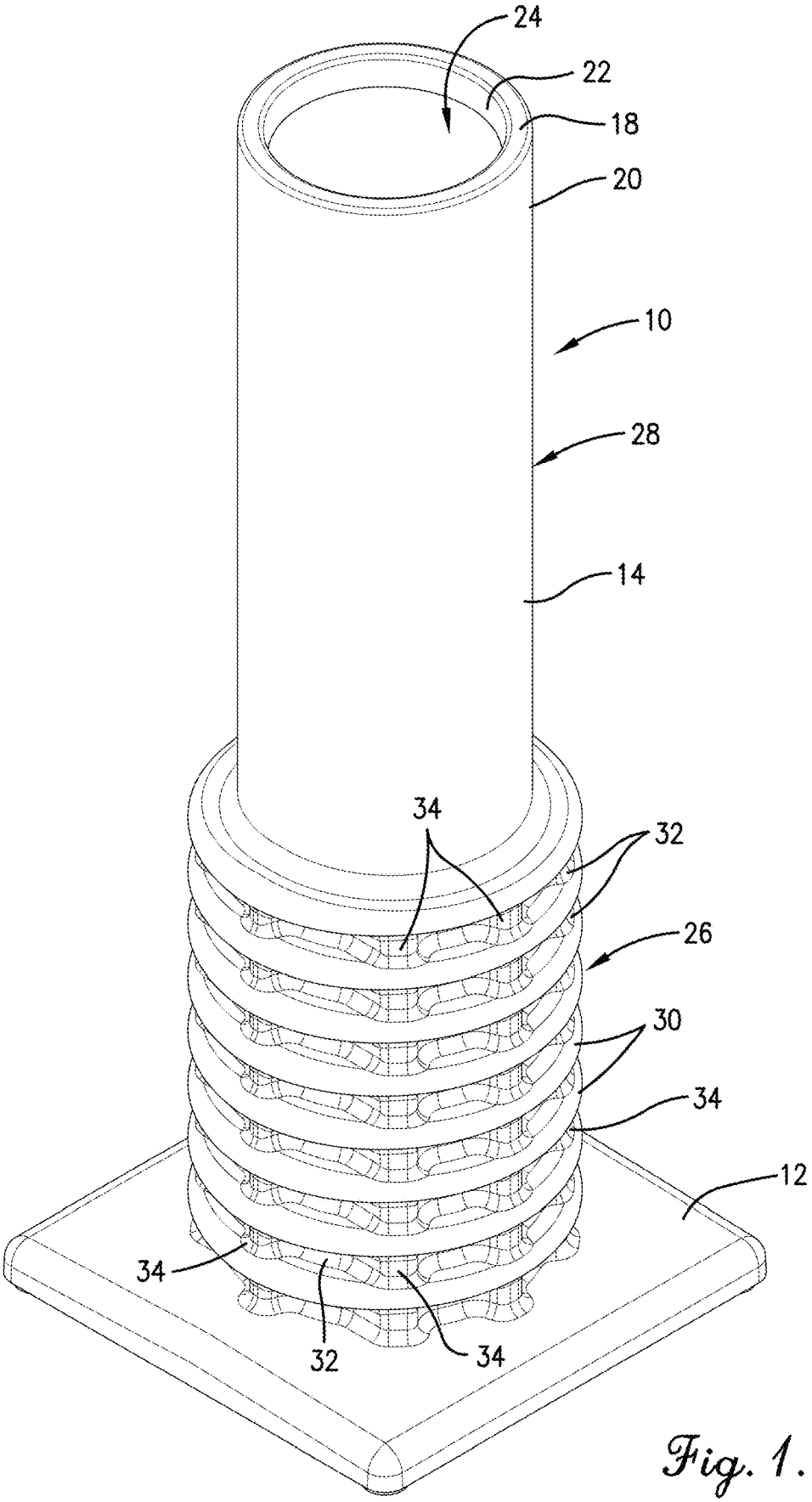
FIG. 1 is a top perspective view of an embodiment of a launching tube for fireworks aerial shells in accordance with the present disclosure.
Figure 2:
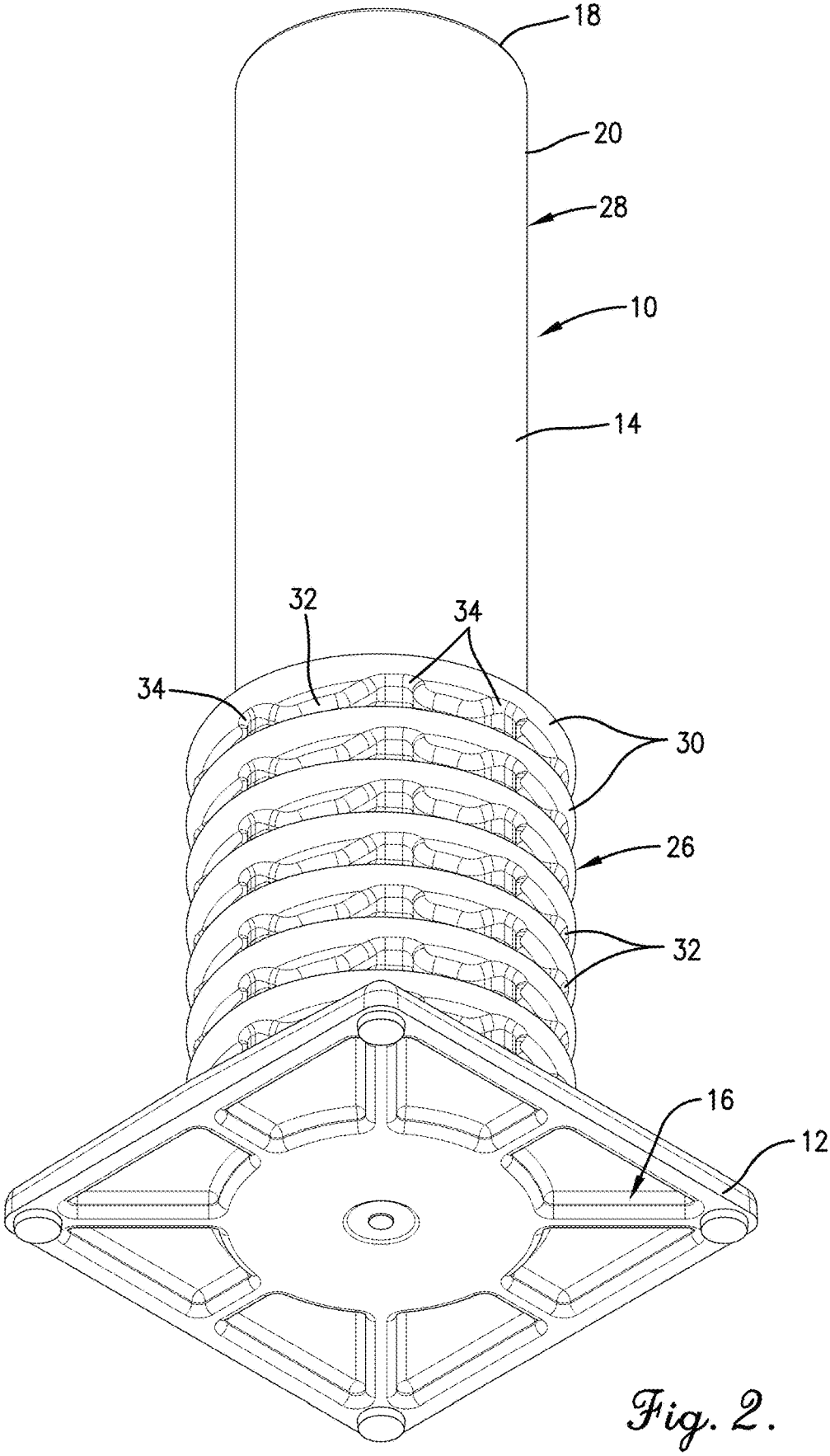
FIG. 2 is a bottom perspective view of the launching tube.
Figure 3:
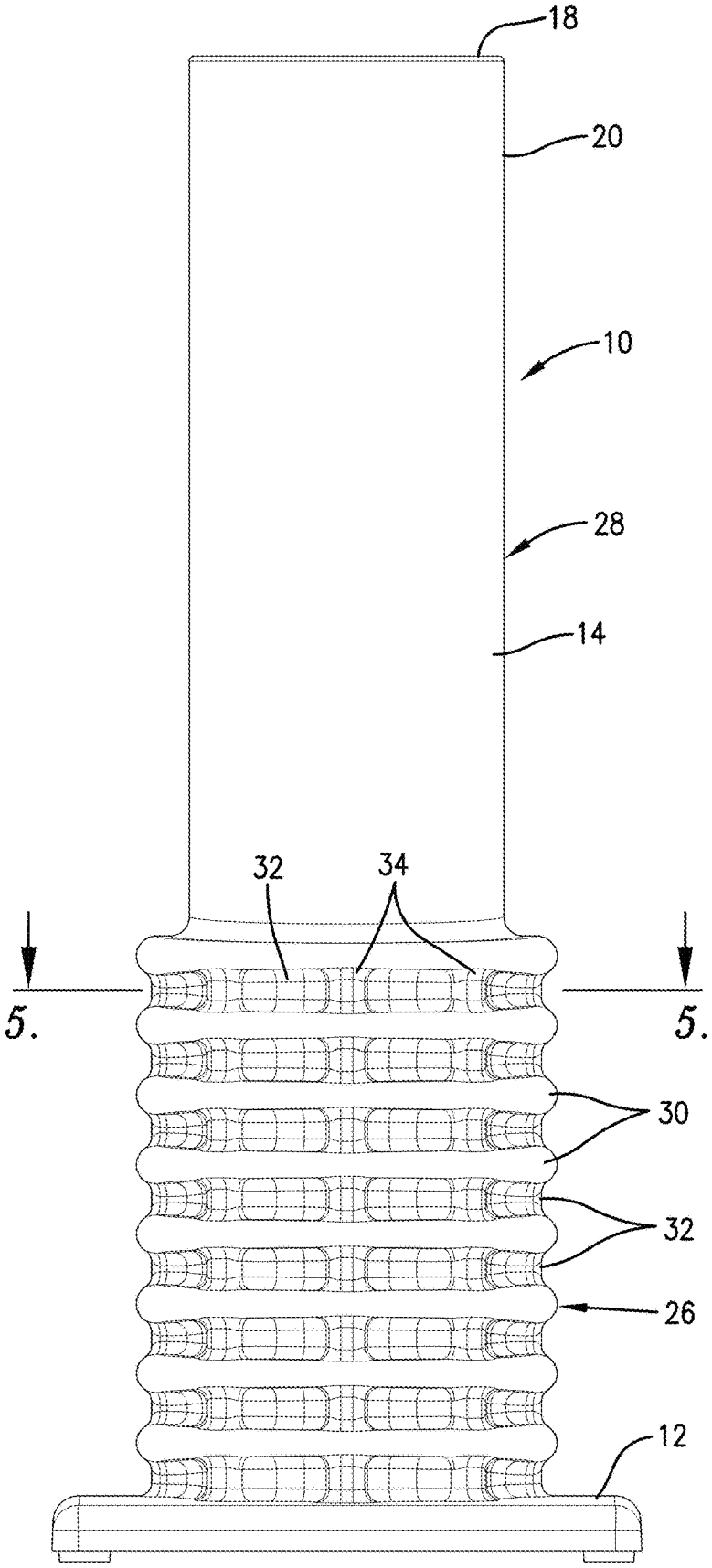
FIG. 3 is a side elevation view of the launching tube.
Figure 4:
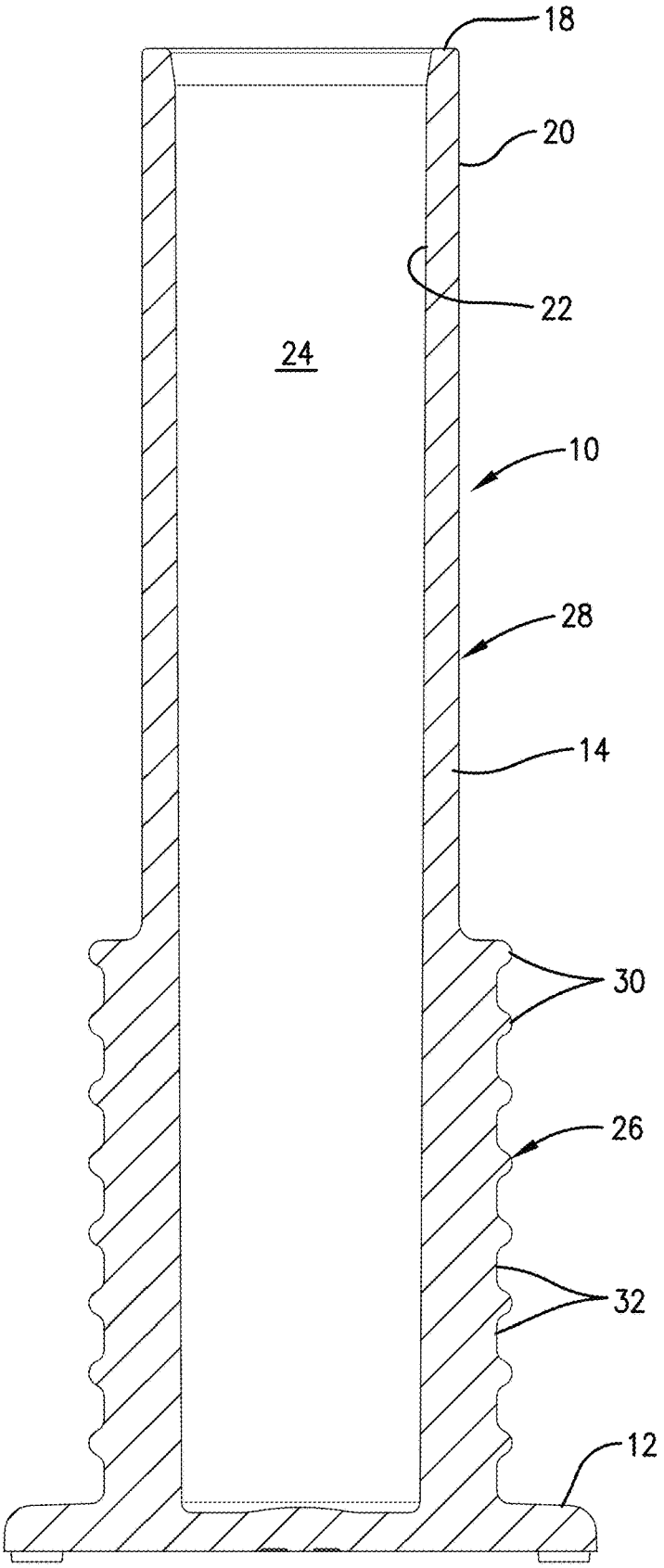
FIG. 4 is a side elevation view of the launching tube taken in vertical section along line 5-5 in FIG. 3 in the direction of the arrows.
Figure 5:
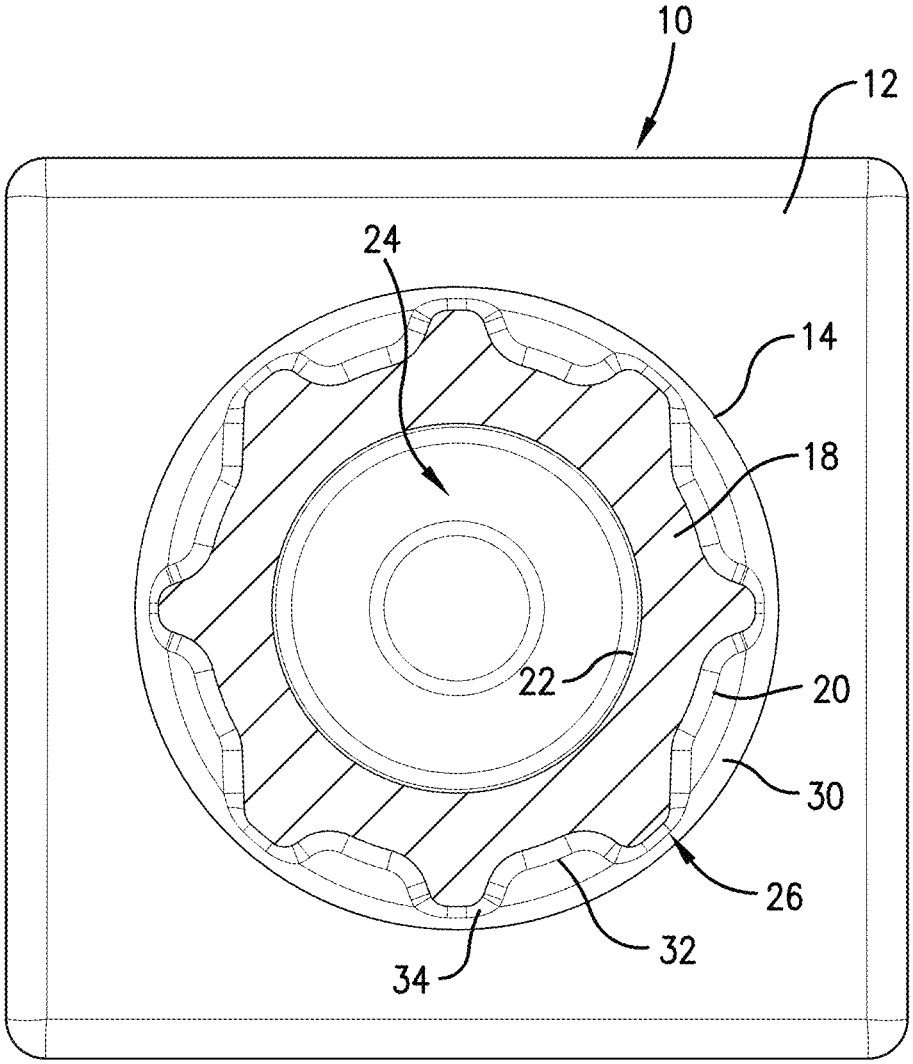
FIG. 5 is a top plan view of the launching tube taken in horizontal section along line 5-5 in FIG. 3 in the direction of the arrows.

Launching tube 10 comprises a base 12 positioned at one end of an elongated tube 14 that extends in a perpendicular or other desired orientation from an upper surface of the base 12. The base 12 may be in the form of a platform that is wider than the elongated tube 14 and is designed to support the elongated tube 14 when placed on a surface such as the ground during launching of the aerial display shell. In one embodiment, the base 12 is generally planar and may be square in configuration. An undersurface of the base 12 may have a reinforcing web-like structure 16 (FIG. 2) that reduces the amount of material that must be used to provide the desired strength and rigidity for the base 12.

The elongated tube 14 comprising a tubular wall 18 having an outer surface 20 and a cylindrical inner surface 22 that defines a cylindrical interior passage 24 for receiving the aerial display shell. The interior passage 24 extends longitudinally in a direction toward the base 12 from an open end of the interior passage 24 that is remote from the base 12. The tubular wall 18 and the interior passage 24 are of a longitudinal length that is greater than a longitudinal length of the aerial display shell that is intended to be launched from the launching tube 10. In one embodiment, the longitudinal length of the tubular wall 18 and the interior passage 24 is within the range of approximately 9-18 inches. In another embodiment, the longitudinal length of the tubular wall 18 and the interior passage 24 is within the range of approximately 11-15 inches.

The interior passage 24 is of a diameter that is greater than the diameter of the aerial display shell that is intended to be launch using the launching tube 10. The difference in diameter between the interior passage 24 and the aerial display shell should be sufficient to allow the aerial display shell to move freely along interior passage 24 while maintaining the aerial display shell in general alignment with the interior passage 24. In one embodiment, the diameter of the interior passage 24 is in the range of approximately 1-4 inches. In another embodiment, the diameter of the interior passage 24 is in the range of approximately 1-3 inches.

The tubular wall 18 has a reinforcing lower section 26 that is located between the base 12 and an upper section 28 of the tubular wall 18. The reinforcing lower section 26 of the tubular wall 18 comprises a series of spaced-apart circumferential ribs 30 that extend in a direction outwardly from the inner surface 22 of the tubular wall. In one embodiment, the circumferential ribs 30 may have an inwardly facing concave outer surface. The circumferential ribs 30 have a tubular wall thickness that is greater than a tubular wall thickness formed by recessed circumferential regions 32 that are located between adjacent ones of the circumferential ribs 30. In one embodiment, at least portions of the recessed circumferential regions 32 may have an outwardly facing concave outer surface. The tubular wall thickness of the circumferential ribs 30 may be greater than a tubular wall thickness of the upper section 28 of the tubular wall 18. The tubular wall thickness of the circumferential regions 32 between adjacent ones of the circumferential ribs 30 may also be greater than the tubular wall thickness of the upper section 28 of the tubular wall 18.

The reinforcing lower section 26 of the tubular wall 18 may further comprise circumferentially spaced-apart connecting ribs 34 that are positioned within the circumferential regions 30 and extend between adjacent ones of the circumferential ribs 30. In one embodiment, the connecting ribs 34 may have an outwardly facing concave outer surface. The connecting ribs 34 and the circumferential ribs 30 form a reinforcing grid that surrounds the interior passage 24 increases the strength of the reinforcing lower section 26 of the tubular wall 18. Connecting ribs 34 may also be positioned between the lowermost circumferential rib 30 and an upper surface of the base 12.

In various embodiments, the number of circumferential ribs 30 may be in the range of 4 to 14 or in the range of 6 to 12. The number of connecting ribs 34 between each adjacent pair of circumferential ribs 30 may be in the range of 4 to 20 or in the range of 4 to 12. In some embodiments, the largest tubular wall thickness of the circumferential ribs 30 may be at least about 50% greater or at least about 80% greater than the tubular wall thickness of the upper section 28 of the tubular wall 18, which may have a uniform thickness.

The circumferential ribs 30 may be formed by complementally shaped surfaces of a mating pair of injection molding plates (not shown) during an injection molding process that forms the circumferential ribs 30 and other components of the launching tube as a unitary, one-piece unit, thereby eliminating the time and expense involved in the conventional process of separately molding a reinforcing sleeve and then sliding it onto the tubular portion of the launching tube. In one embodiment, the thermoplastic material may be injected along a central axis from the base 12 so that the thermoplastic material fills the mold in a direction from the base 12 toward the upper section 28 of the tubular wall 18. The resulting launching tube 10 is thereby formed without any seams that may weaken the launching tube 10.

The contours of the circumferential ribs 30 allow the injection molding plates to securely grip the launching tube 10 and move it longitudinally off a central core (not shown) that forms the inner surface 22 of the tubular wall 18 during the injection molding process. The thinner tubular wall thickness of the circumferential regions 32 between the circumferential ribs 30 allows quicker cooling and hardening of the reinforcing lower section 26 so that the unitary, one-piece launching tube 10 has a greater opportunity to retain its desired shape following ejection of the launching tube 10 from the central core and the plates following the injection molding process. This also allows ejection to occur with reduced localized stresses that might deform portions of the launching tube 10 and may more quickly degrade the injection molding central core and plates.

It can be seen that the circumferential ribs 30 may help to contain the overpressure that may be created when the aerial display shell is improperly placed into the interior passage 24 in an inverted position and the effects charge is ignited while within the interior passage 24. Alternating the circumferential ribs 30 with the thinner walled circumferential regions 32 advantageously allows quicker cooling of the reinforcing lower section 26 and uses less material than required by the conventional reinforcing sleeve that has a uniform wall thickness.

Additional Considerations

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

In the specification and claims, reference will be made to several terms, which shall be defined to have the following meanings. The singular forms "a," "an," and "the" include plural references unless the context clearly dictates otherwise.

Approximating language, as used herein throughout the specification and the claim, may be applied to modify any quantitative representation that could permissibly vary without resulting in a change in the basic function to which it is related. Accordingly, a value modified by a term or terms, such as "about" and "substantially" are not to be limited to the precise value specified. In at least some instances, the approximating language may correspond to the precision of an instrument for measuring the value. Range limitations may be combined and/or interchanged. Such ranges are identified and include all the sub-ranges contained therein unless context or language indicates otherwise.

As used herein, the terms such as "side" and similar terms are used herein solely for convenience and should be understood only in relation to each other.

The terms "secured," "coupled," "attached to," and the like refer to both direct coupling, fixing, or attaching, as well as indirect coupling, fixing, or attaching through one or more intermediate components or features, unless otherwise specified herein.

Although the present application sets forth a detailed description of different embodiments, it should be understood that the legal scope of the description is defined by the words of the claims and equivalent language. The detailed description is to be construed as exemplary only and does not describe every possible embodiment because describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in this paragraph shall apply unless so stated in the description and/or except as will be readily apparent to those skilled in the art from the description.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

Although the disclosure has been described with reference to the embodiments illustrated in the attached figures, it is noted that equivalents may be employed, and substitutions made herein, without departing from the scope of the disclosure as recited in the claims.

What is claimed is:

1. A launching tube for launching a consumer fireworks aerial display shell having a lift change and an effects charge, the launching tube comprising:

a base;

an elongated tube extending from the base and comprising a tubular wall having an outer surface and an inner surface that defines a cylindrical interior passage for receiving and guiding an aerial display shell during its launch, the interior passage extending in a direction toward the base from an open end that is remote from the base;

the tubular wall having a reinforcing lower section that is located between the base and an upper section of the tubular wall; and the reinforcing lower section of the tubular wall comprising:

a series of spaced-apart circumferential ribs that extend in a direction outwardly from the inner surface and have a tubular wall thickness that is greater than a tubular wall thickness formed by circumferential regions that are located between adjacent ones of the circumferential ribs, wherein the tubular wall thickness of the circumferential ribs is greater than a tubular wall thickness of the upper section of the tubular wall; and circumferentially spaced-apart connecting ribs extending between adjacent pairs of the circumferential ribs.

2. The launching tube of claim 1, wherein the tubular wall thickness of the circumferential regions that are located between adjacent ones of the circumferential ribs is greater than the tubular wall thickness of the upper section of the tubular wall.

3. The launching tube of claim 1, wherein a longitudinal length of the upper section of the tubular wall is greater than a longitudinal length of the reinforcing lower section.

4. The launching tube of claim 1, wherein the number of circumferential ribs is in the range of 6 to 12.

5. The launching tube of claim 4, wherein the number of connecting ribs between each adjacent pair of circumferential ribs is in the range of 4 to 12.

6. The launching tube of claim 1, wherein the tubular wall thickness of the circumferential ribs is at least about 50% greater than the tubular wall thickness of the upper section of the tubular wall.

7. The launching tube of claim 1, wherein the tubular wall thickness of the circumferential ribs is at least 80% greater than the tubular wall thickness of the upper section of the tubular wall.

8. The launching tube of claim 1 formed of a thermoplastic polymer.

9. The launching tube of claim 1 formed of high-density polyethylene.

10. A launching tube for launching a consumer fireworks aerial display shell having a lift change and an effects charge, the launching tube comprising:

a base;

a one-piece elongated tube formed integrally with and extending from the base, the elongated tube comprising a tubular wall having an outer surface and an inner surface that defines a cylindrical interior passage for receiving and guiding an aerial display shell during its launch, the interior passage extending in a direction toward the base from an open end that is remote from the base;

the tubular wall having a reinforcing lower section that is located between the base and an upper section of the tubular wall; and the reinforcing lower section of the tubular wall comprising:

a series of spaced-apart circumferential ribs that extend in a direction outwardly from the inner surface and have a tubular wall thickness that is greater than a tubular wall thickness formed by circumferential regions that are located between adjacent ones of the circumferential ribs; and circumferentially spaced-apart connecting ribs extending between adjacent ones of the circumferential ribs.

11. The launching tube of claim 10, wherein the tubular wall thickness of the circumferential ribs is greater than a tubular wall thickness of the upper section of the tubular wall.

12. The launching tube of claim 11, wherein the tubular wall thickness of the circumferential regions that are located between adjacent ones of the circumferential ribs is greater than the tubular wall thickness of the upper section of the tubular wall.

13. The launching tube of claim 12, wherein a longitudinal length of the upper section of the tubular wall is greater than a longitudinal length of the reinforcing lower section.

14. The launching tube of claim 13, wherein the number of circumferential ribs is in the range of 6 to 12.

15. The launching tube of claim 14, wherein the number of connecting ribs between each adjacent pair of circumferential ribs is in the range of 4 to 12.

16. The launching tube of claim 10, wherein the tubular wall thickness of the circumferential ribs is at least 80% greater than the tubular wall thickness of the upper section of the tubular wall.

17. The launching tube of claim 10 formed of high-density polyethylene.

18. A launching tube formed of high-density polyethylene for launching a consumer fireworks aerial display shell having a lift change and an effects charge, the launching tube comprising:

a base;

a one-piece elongated tube extending from the base, the elongated tube comprising a tubular wall having an outer surface and an inner surface that defines a cylindrical interior passage for receiving and guiding an aerial display shell during its launch, the interior passage extending in a direction toward the base from an open end that is remote from the base;

the tubular wall having a reinforcing lower section that is located between the base and an upper section of the tubular wall; and the reinforcing lower section of the tubular wall comprising:

a series of circumferential ribs that extend in a direction outwardly from the inner surface and are spaced apart by circumferent regions that are located between adjacent ones of the circumferential ribs, the circumferential ribs having a tubular wall thickness that is greater than a tubular wall thickness of the circumferential regions; and circumferentially spaced-apart connecting ribs extending between the adjacent ones of the circumferential ribs, wherein the tubular wall thickness of the circumferential ribs is greater than a tubular wall thickness of the upper section of the tubular wall, wherein the tubular wall thickness of the circumferential regions that are located between adjacent ones of the circumferential ribs is greater than the tubular wall thickness of the upper section of the tubular wall, wherein a longitudinal length of the upper section of the tubular wall is greater than a longitudinal length of the reinforcing lower section.

* * * * *